US005403055A

United States Patent [19]

Allison

[11] Patent Number: 5,403,055

[45] Date of Patent: Apr. 4, 1995

[54] CARGO UNITS OF PANELS

[76] Inventor: Robert S. Allison, 203 B Lentz Rd., Yulee, Fla. 32097

[21] Appl. No.: 46,560

[22] Filed: Apr. 16, 1993

[51] Int. Cl.[6] ..... B66C 1/62

[52] U.S. Cl. ..... 294/67.1; 52/125.2; 52/125.6

[58] Field of Search ..... 294/67.1, 68.1, 81.1, 294/81.5, 87.1; 52/122.1, 125.1, 125.2, 125.6, 745.02

[56] References Cited

U.S. PATENT DOCUMENTS

| | | | |
|---|---|---|---|
| 1,940,186 | 12/1933 | Romine | 294/67.1 X |
| 3,386,600 | 6/1968 | Betjemann | 294/68.1 X |
| 3,405,665 | 10/1968 | Slonim | 294/68.1 X |
| 3,768,686 | 10/1973 | Mappes | 294/68.1 X |
| 4,016,974 | 4/1977 | Tax | 294/68.1 X |
| 5,193,325 | 3/1993 | Allison | 52/125.2 X |

FOREIGN PATENT DOCUMENTS

| | | | |
|---|---|---|---|
| 2159856 | 6/1972 | Germany | 294/68.1 |
| 508463 | 3/1976 | U.S.S.R. | 294/81.5 |

*Primary Examiner*—Dean J. Kramer
*Attorney, Agent, or Firm*—Arthur G. Yeager

[57] ABSTRACT

A rigid assemblage of a plurality of elongated parallel building construction components adapted to function as an ocean cargo unit, the assemblage including four parallel vertical load bearing beams having at each end of each beam a fitting with a plurality of lifting eyes with all of the fittings and the beams forming three pairs of parallel planes which enclose a right prismatic space wherein all of the elongated members, are held rigidly in parallel arrangement when the assemblage is suspended by a lifting force, applied simultaneously to all beams.

15 Claims, 6 Drawing Sheets

CARGO UNITS OF PANELS

BACKGROUND OF THE INVENTION

During the last 40 years many innovations have been made in the industry of factory built housing and buildings. These industries are generally divided into three basic categories which are known as modular, panelized, and component. In the modular system, houses, buildings or portions of either are constructed which include a floor, walls, and roof and enclose a living space. The panelized system is different in that no enclosed living space is produced in the factory. Instead, finished wall, floor, ceiling and roof panels are built in a factory and are then transported to a housing or building site where they are assembled to enclose a living space. The component segment of the industry produces the least finished manufactured parts of building structures which are mostly assembled structural frames built of wood and would include wall frames, flooring systems, and roof trusses. The finished and precut logs used to build log homes can also be considered components.

In my copending application Ser. No. 07/799,561 filed Nov. 27, 1991, now U.S. Pat. No. 5,193,325, there are disclosed methods and systems for making modular buildings stackable and more transportable. The systems disclosed in the present application provide similar new efficiencies for shipping building panels and building components.

In the instances where panelized buildings for housing are shipped overseas, the completed or semi-finished panels have in the past been shipped inside a standard overseas container, sometimes with walls and floors and ceilings hinged to each other as in U.S. Pat. No. 4,891,919. This also has been the method for shipping components. As is well known, there exists a world wide infrastructure of equipment and ocean going ships specially designed for transporting these standard overseas shipping containers.

It is an object of this invention to provide articles of manufacture as well as an accompanying method for facilitating the road transportation and overseas shipping of both construction panels and other elongated construction components, using the existing worldwide transportation infrastructure for shipping overseas containers. It is another object to provide methods and equipment whereby panels and components may be stacked and transported without the need for utilizing an overseas container. These inventions also provide for the most economical shipment of panels and components, which, because of their size, cannot fit within the inside dimensions of a standard overseas container. Other objects of this invention include more efficient use of cargo space aboard ships, the ability to stack these new cargo units in storage, and the ability to transport them over the highways on the same semitrailers used for transporting overseas containers. These inventions provide new shipping efficiencies by eliminating the need for an overseas container and by using the structure and dimensions of the cargo itself to position the material handling hardware.

BRIEF SUMMARY OF THE INVENTION

This invention relates to a system for transporting an ocean cargo of elongated construction components which comprises assembling a plurality of identical elongated construction components in parallel, spaced, rigid relationship, with the assemblage being supported by four parallel, vertical load bearing beams, each end of each beam terminating in a fitting with a plurality of lifting eyes, the fittings being positioned to define three pairs of parallel planes enclosing a right prismatic, parallelepipedic space meeting the dimensions of standard shipping containers for use on ocean-going vessels.

In specific and preferred embodiments of the invention the construction components may be panels, trusses, or the like; the end frames may be rectangular structures of load supporting beams; the lifting eyes must meet ISO standards; the end frames may have telescopic, extendable vertical beams; and the construction components may be screwed or bolted directly to the end frames.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may be best understood by reference to the following description taken in connection with the accompanying drawings in which:

DETAILED DESCRIPTION OF THE INVENTION

This invention relates to a system for packaging a plurality of elongated parallel objects to make them easily shippable as cargo freight. It has already been mentioned that cargo freight is shipped via vessel, truck and airplane in closed cargo containers that are standard sizes and are equipped with standard lifting eye fittings. These containers are 8 ft. by 8.5 ft. by 20, 30 or 40 ft. long. It is the purpose of this invention to make a package that is fully compatible with closed cargo containers but is less bulky, less weighty, and less expensive than the use of closed cargo containers. The package does not enclose the shipped material, although, if desired, the shipped material, may be enclosed in thin plastic film to protect finishes that might be harmed by flying dust.

Figure 1:
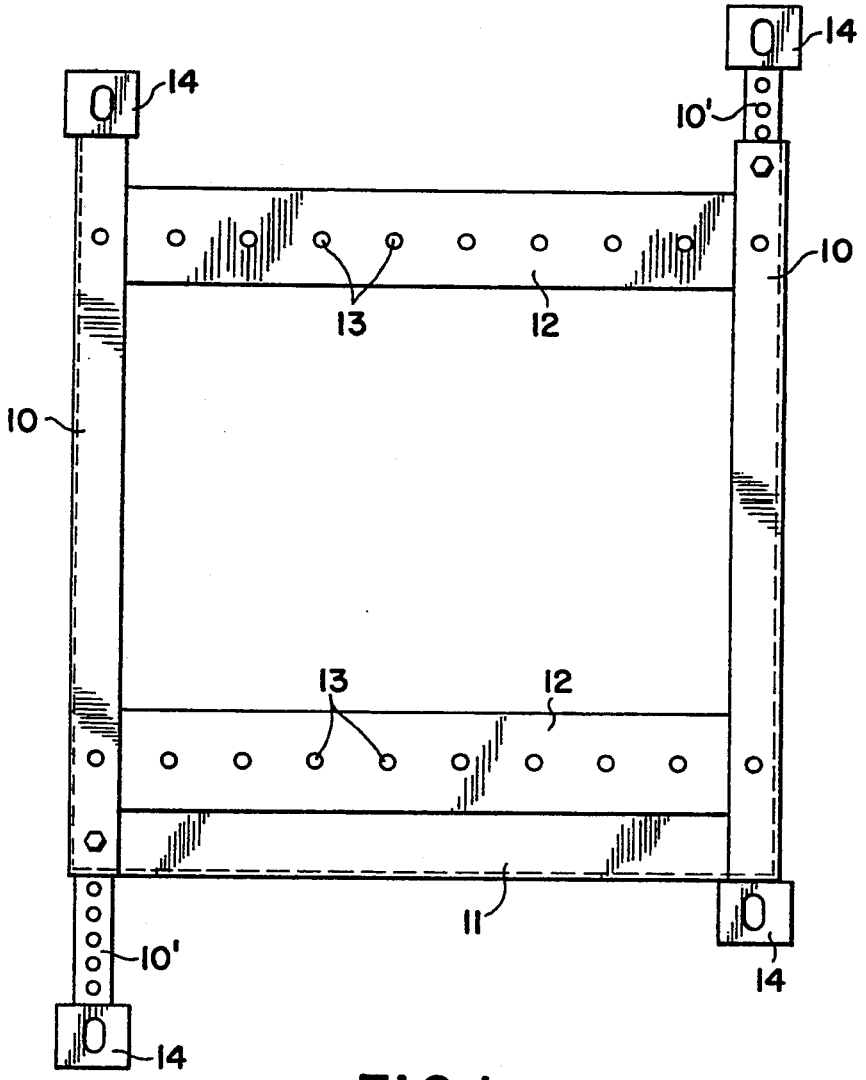
FIG. 1 is a front elevational view of the end frame of this invention.
Figure 3:
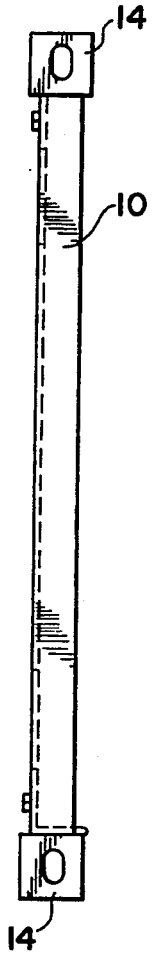
FIG. 3 is a side elevational view of the end frame of FIG. 1.
Figure 2:
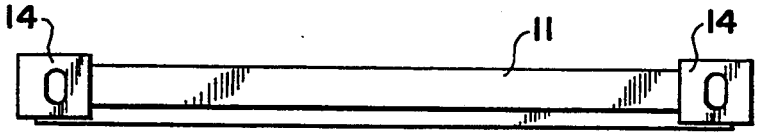
FIG. 2 is a bottom plan view of the rectangular end frame of FIG. 1.

In FIGS. 1–3 there is shown an end frame. In the preferred embodiment of this invention the package requires a pair of such end frames as well as a plurality of fasteners, such as bolts and nuts, or lag screws. Each end frame comprises two vertical load supporting beams 10, preferably L-beams or angle beams, although other shaped beams are entirely suitable. Horizontal beams 11 or horizontal plates 12 are necessary to form a rigid, rectangular frame. Preferably lower beam 11 is an angle beam or L-beam so as to provide a horizontal ledge or shelf upon which the shipped components may rest. Two lateral, horizontal spaced plates 12 are needed with a plurality of spaced holes 13 to receive fasteners to support the individual elongated members being packaged for shipment. The construction of the end frame preferably is by welding beams 10 to beam 11 and plates 12, although bolting is a feasible alternative. Welding is preferred so as to make a planar surface for contact with the shipped components.

On each of the four corners of each frame there is a fitting 14 with a plurality of lifting eyes. The fitting must conform in dimensions to the standards of the International Organization for Standardization, ISO 1161. Such fittings 14 are available in the open market as steel castings that are welded to the ends of vertical beams 10, which may be telescopic beams 10'. These fittings 14 are used for lifting the package by a crane having a cable with four hooks. These fittings are also used for stacking one container or package on top of another for shipping. A special locking bolt (not shown) connects eye-to-eye in adjacent containers or packages to produce stable stacks of containers or packages.

Figure 4:
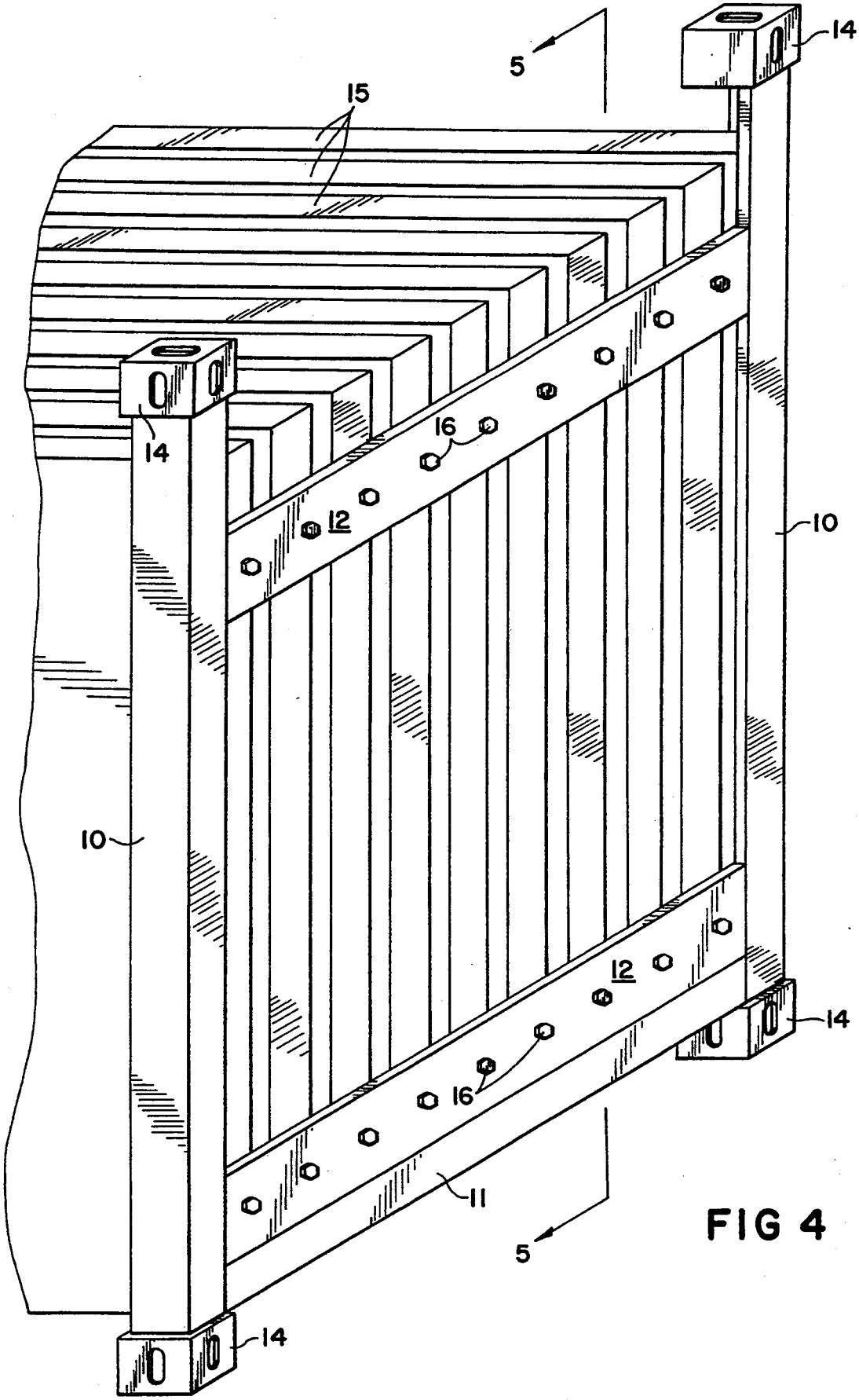
FIG. 4 is a perspective view of the end frame of FIG. 1 as it is used to package construction panels for shipment as cargo freight.

The manner in which the end frames of FIGS. 1–3 are used to package components that are in the form of panels is shown in FIG. 4. The panels 15 are assembled in spaced parallel relationship, and an end frame is rigidly attached at each end of the assemblage of panels 15 to make the package of FIG. 4. The connection between the end frame and each panel 15 is made by lag screws 16 which extend through predrilled holes 13 in each horizontal plate member 12 and into the end of the respective panel. If the panel 15 has a ledge, a recess, or other feature to accept it, the lag screw 16 may be replaced by a bolt and nut or other clamping means that will rigidly tighten panel 15 to horizontal plate 12. It will be appreciated that when all panels 15 are rigidly attached at both ends to an end frame, the result is a rigid package that can completely replace a closed cargo container filled with such panels. In some special instances lower plate 12 may not be needed, if beam 11 has a sufficiently long vertical leg to receive a plurality of drilled holes 13, through which lag screws 16 or bolts can be applied to connect panels 15 tightly to beam 11.

Figure 5:
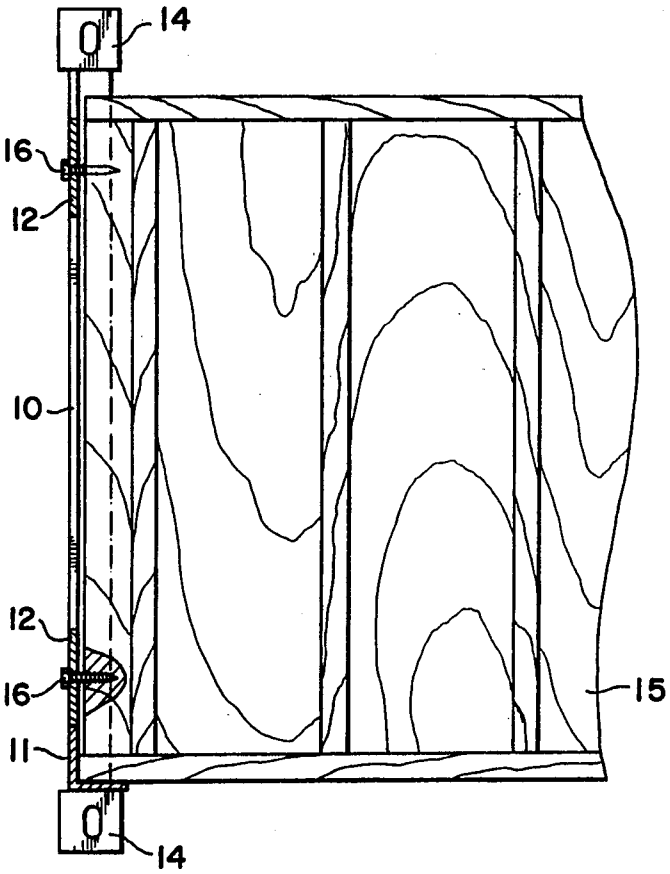
FIG. 5 is a cross-sectional view taken at 5—5 of FIG. 4.

FIG. 5 shows a cross-sectional view to indicate how the panel 15 is placed against and held tightly to the end frame. Lower angle beam 11 serves as a shelf or ledge on which each panel 15 rests while lag screws 16 tighten the panel 15 against the inside surface of horizontal plate 12.

Figure 6:
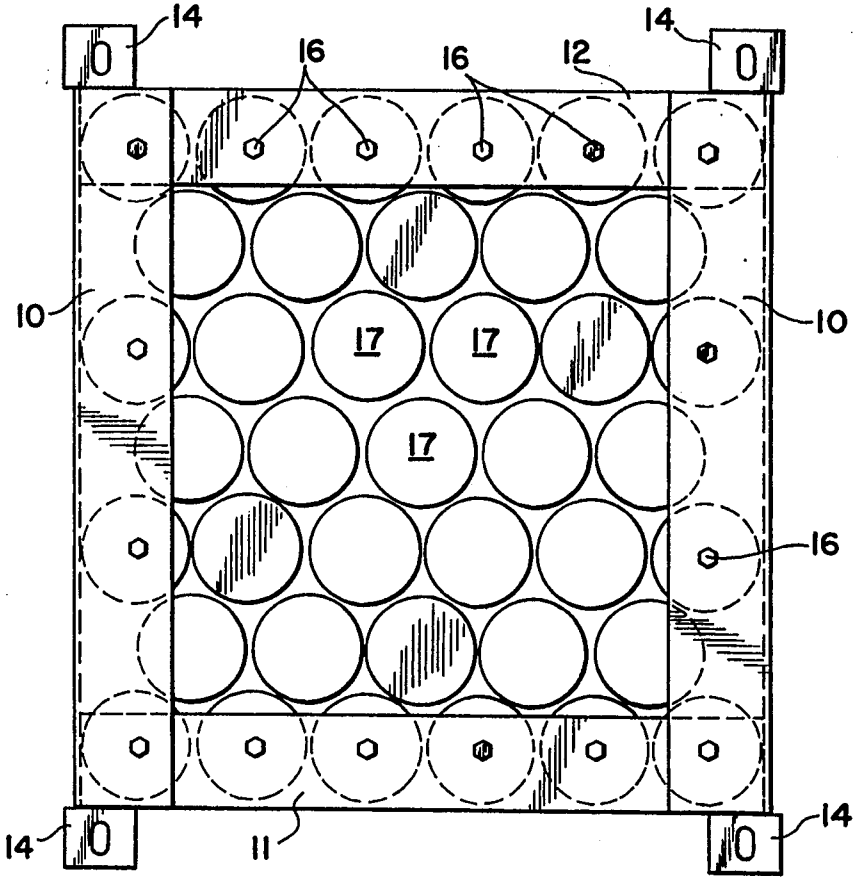
FIG. 6 is a front elevational view showing the end frame attached by lag screws to the individual log components.

FIG. 6 shows how a plurality of logs might be shipped using the end frames of this invention. Each log 17 has a lag screw 16 tightened into the end of the log 17, except those logs 17 in the middle of the assemblage. By adding a sheet of plastic, wood, fiberboard, or the like, between the ends of the logs 17 and the end frame, only the logs around the perimeter need be attached by a lag screw 16. This modification is shown in FIG. 6. It should also be noted that lower plate 12 is omitted in FIG. 6 because the logs 17 are small enough to permit lag screws 16 through holes in the vertical leg of horizontal L-beam 11. If such were not sufficient, lower plate 12 could be added as is the case in FIGS. 1–4.

Figure 7:
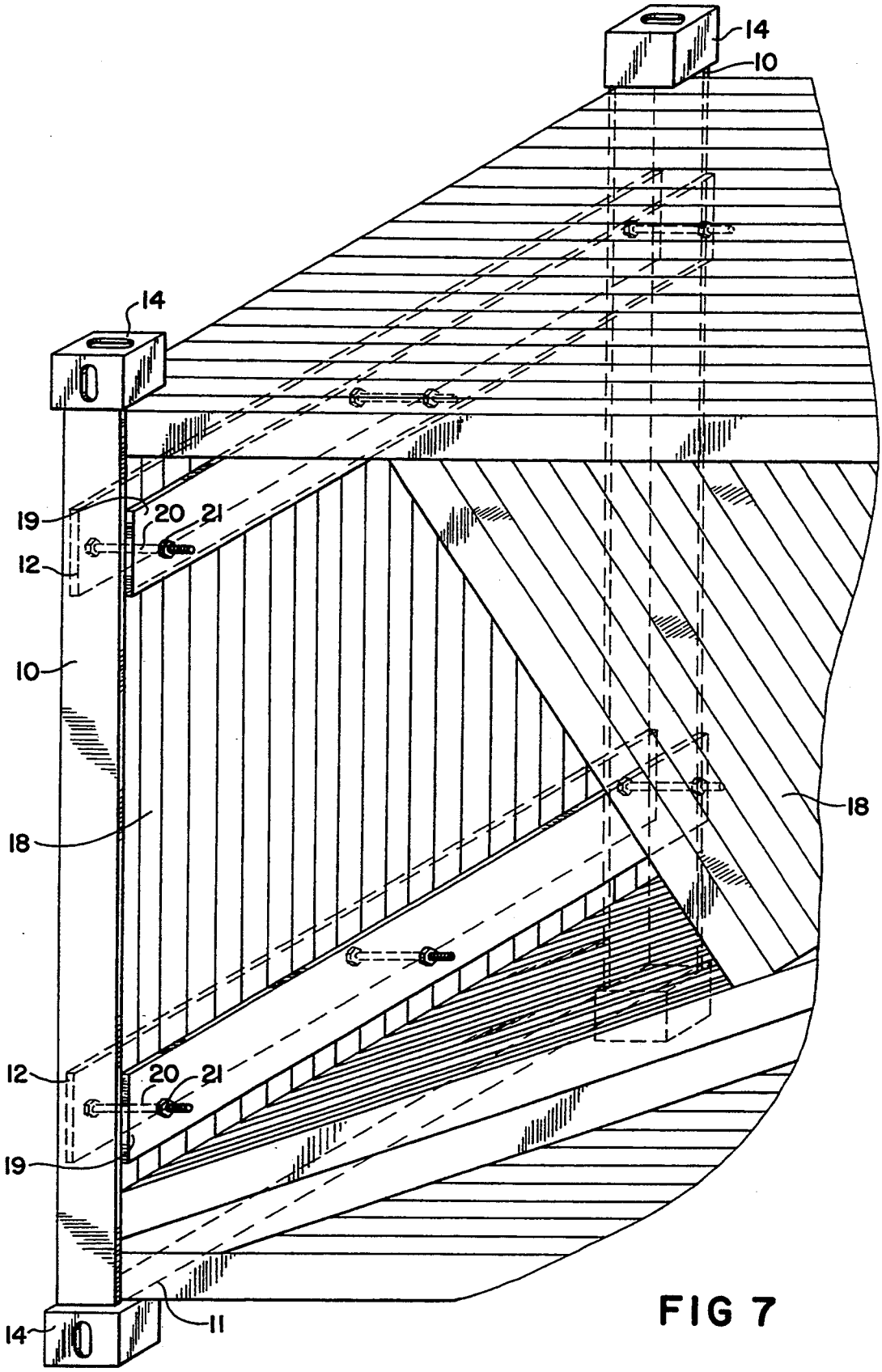
FIG. 7 is a perspective view showing the end frame of this invention modified to include a clamping mechanism for holding a plurality of roof trusses in parallel arrangement.

FIG. 7 shows a package of roof trusses which do not lie flat against very much of the end frame. In this case a clamp means is employed with a movable plate 19 forming one jaw of a clamp with the stationary plate 12 of the end frame serving as the other jaw of the clamp. Long bolts 20 and nuts 21 are assembled to provide the clamping force. All that is necessary is that there be a suitable purchase for clamping plate 19 to tighten against.

Figure 8:
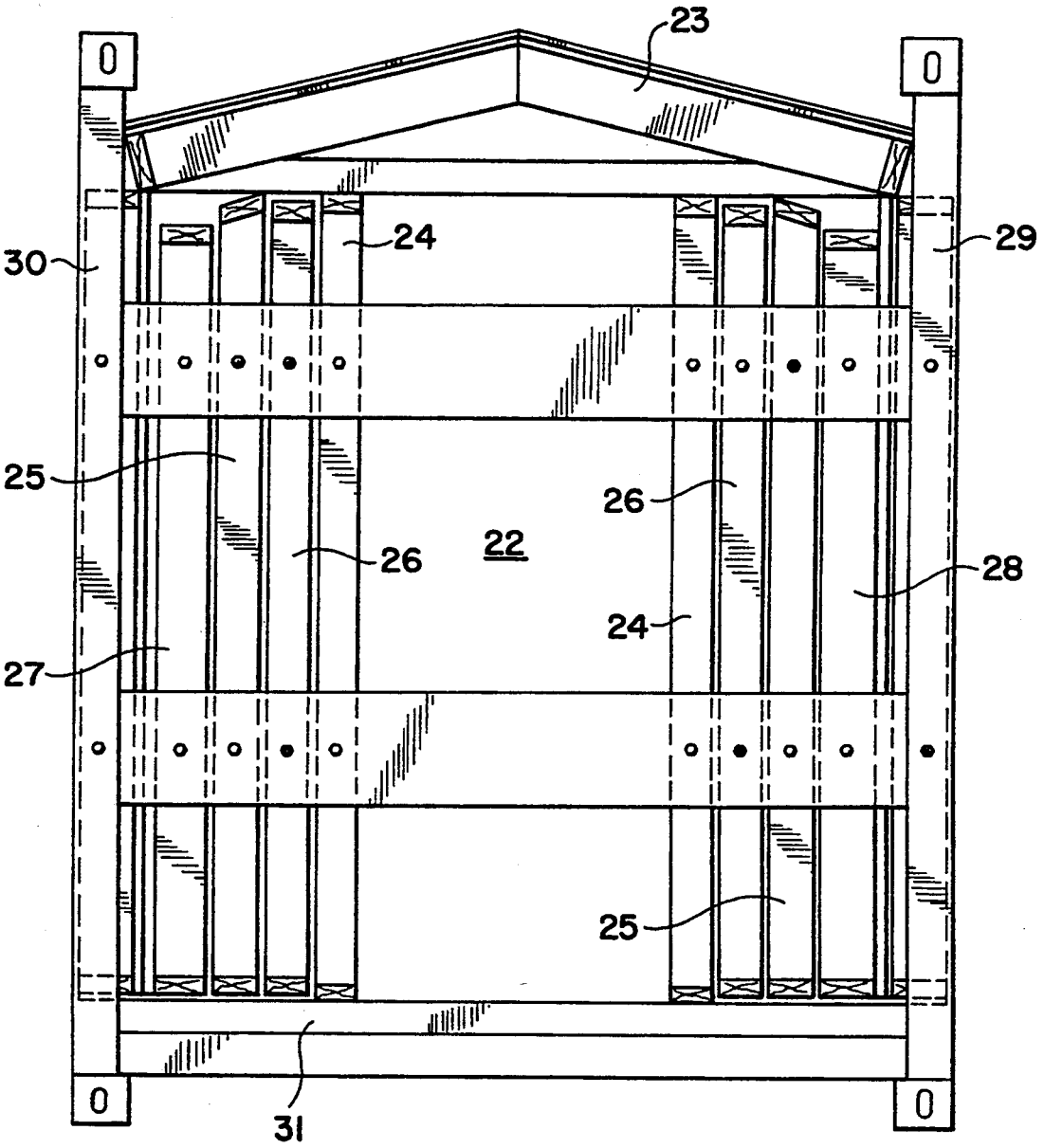
FIG. 8 is a front elevational view of the end frame attached to the mechanical core, floor sections, walls, and roof sections of a pre-fabricated panelized home or building.

FIG. 8 shows a front elevational view which reveals a cross section of how a pre-fabricated panelized home or building can be packaged for shipping. The building shown consists of a mechanical core 22, which would likely include a finished kitchen and bathroom under a fixed roof section 23. In this embodiment, surrounding the core and held in suspension at their ends, as described above with respect to FIGS. 1–5, are finished interior wall panels 24, exterior side and end panels 25 and 26, floor panels 27 and 28, and finished roof panels 29 and 30. With panels packaged in this fashion the fixed roof section 23 and the roof panels 29 and 30 are placed on the outside locations of the package to protect the balance of the panels from exposure to the elements of weather in shipping. The interior wall panels 24 and 25, the fixed roof section 23, and the finished floor section 31 over its entire length, preferably are affixed to each other to provide a rigid assembly to support the package, and will remain in that assembly when the house is later assembled at the building site. Alternatively these panels, and/or other panels may be supported in shipping by temporary attachments to any or all of the other panels held in suspension from their ends on end frames as in FIGS. 1–4. The panels in this packaged bundle can be completely finished in the manufacturing plant, including installed doors and windows and interior and exterior wall coverings.

Figure 9:
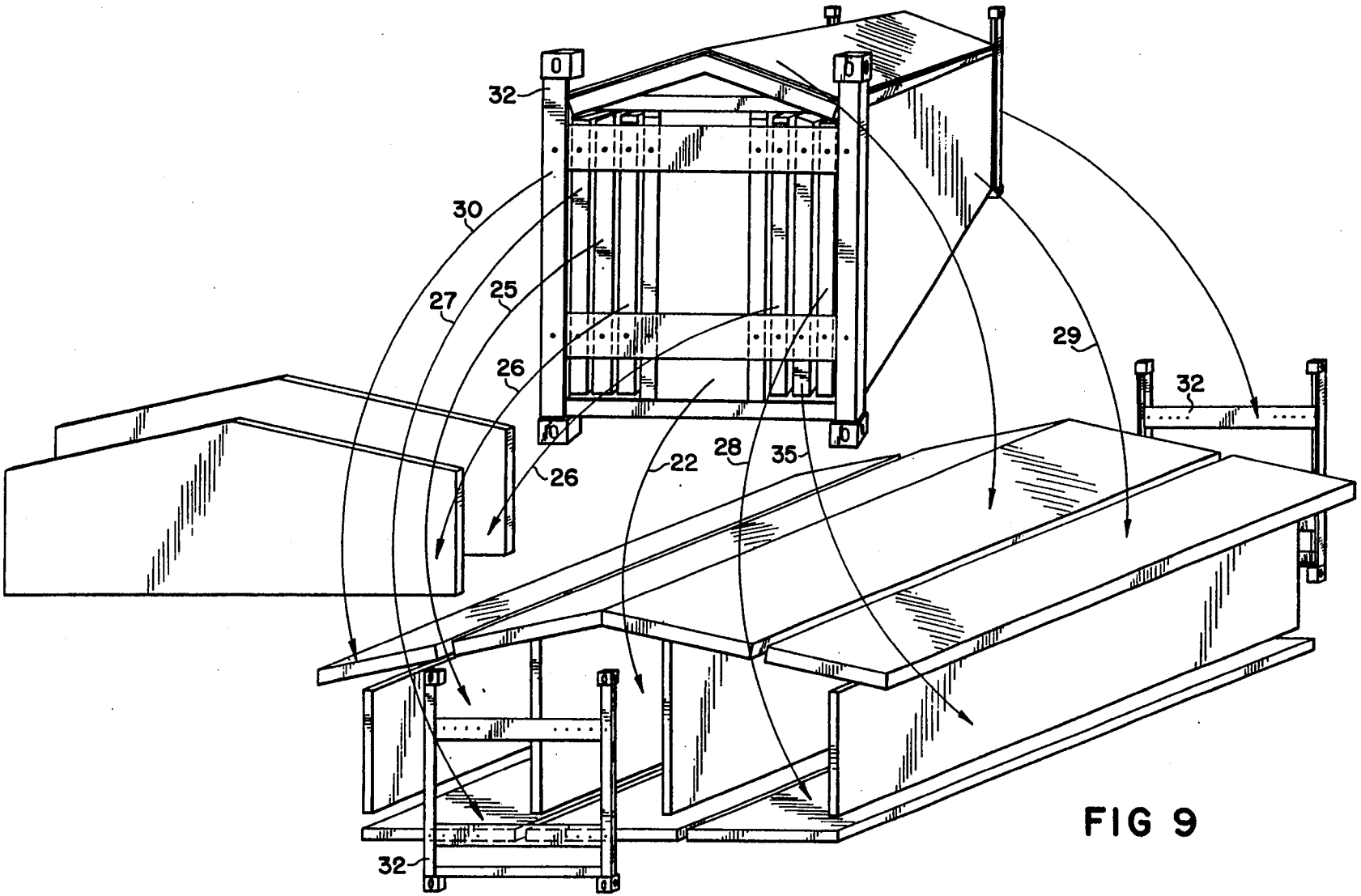
FIG. 9 is an exploded perspective view of the bundle of prefabricated panels assembled as shown in FIG. 8, and separated to indicate how those panels are assembled to prepare a finished building.

FIG. 9 shows a perspective view of the package of panels in FIG. 8, and also how, at delivery of the package to the building site, the end frames 32 are removed and each of the panels 25–30 are then fastened into place around core 22 to form a finished prefabricated building or house.

It should be apparent that the features of this invention may be applied to package almost any elongated construction component whether they nest together neatly or not, and whether planar or not. Other planar cargoes might include solar panels or prestressed hollow core concrete slabs. Nonplanar cargoes might include large diameter steel oil field pipe or large diameter concrete storm drainage pipe. Cargoes, other than construction materials, may similarly benefit from being packaged and shipped utilizing this system.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A system for transporting elongated construction components which comprises an assemblage of a plurality of elongated discrete, unattached construction components in parallel spaced relationship with ends thereof rigidly attached respectively, to two lateral rectangular load bearing end frames to produce a rigid structure having four vertical corner beams, each having a fitting with a plurality of lifting eyes, said fittings being positioned to define three pairs of spaced parallel planes enclosing a right prismatic, parallelepipedic space meeting the dimensions of standard overseas shipping containers for use on ocean-going vessels.

2. The system of claim 1 wherein said construction components are panels.

3. The system of claim 1 wherein said components are attached to said end frames by screw thread means.

4. The system of claim 3 wherein said screw thread means is a lag screw.

5. The system of claim 3 wherein said screw thread means is a bolt and nut.

6. The System of claim 1 wherein said components are attached to said end frames by a clamping means wherein said end frame cooperates with a movable member to clamp a portion of said component therebetween.

7. The system of claim 1 wherein each said end frame comprises two spaced vertical beams rigidly attached to two spaced horizontal beams, each said vertical beam having on each of its two ends a fitting with three oval lifting eyes conforming to the design of standard fittings for ocean-going cargo.

8. The system of claim 1 wherein each said vertical beam is telescopically extendable.

9. The system of claim 1 wherein said construction components are prefabricated to be assembled into a building.

10. The system of claim 9 wherein one of said construction components is a core component to which are attached small pieces of equipment to be used in the finished building.

11. The system of claim 10 wherein said core component includes a space enclosed by wall, floor, and roof construction components, with said equipment in said enclosed space.

12. The system of claim 9 wherein said construction component intended for use as a horizontal floor section of said prefabricated building is rigidly attached horizontally to said construction component intended for use as a vertical panel of said prefabricated building and wherein said vertical panel is held in suspension between said end frames.

13. The system of claim 9 wherein said component core is supported by attachment to at least one said vertical panel suspended between said end frames.

14. The system of claim 9 wherein all said construction components and said equipment needed to erect a completed building are contained in a single, shippable ocean cargo assemblage of said components.

15. The system of claim 1 wherein said construction components are positioned with roof panels on the outside of said plurality of components so as to protect inside panels from effects of weather on said plurality.

* * * * *